US011336041B2

(12) United States Patent
Shimizu

(10) Patent No.: US 11,336,041 B2
(45) Date of Patent: May 17, 2022

(54) RELAY TERMINAL, AND METHOD FOR PRODUCING RELAY TERMINAL

(71) Applicant: YAZAKI CORPORATION, Tokyo (JP)

(72) Inventor: Isanori Shimizu, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 25 days.

(21) Appl. No.: 17/033,658

(22) Filed: Sep. 25, 2020

(65) Prior Publication Data

US 2021/0098910 A1 Apr. 1, 2021

(30) Foreign Application Priority Data

Sep. 27, 2019 (JP) ..... JP2019-177674

(51) Int. Cl.
*H01R 12/58* (2011.01)
*H01R 43/16* (2006.01)
*H01R 4/02* (2006.01)

(52) U.S. Cl.
CPC ..... *H01R 12/585* (2013.01); *H01R 43/16* (2013.01); *H01R 4/029* (2013.01)

(58) Field of Classification Search
CPC ..... H01R 12/585; H01R 43/16; H01R 4/029
USPC ..... 439/775
See application file for complete search history.

(56) References Cited

U.S. PATENT DOCUMENTS 2,061,961 A * 11/1936 Culver ..... H01R 13/115 439/742
2,962,693 A * 11/1960 Ott ..... H01R 39/36 439/849
6,264,510 B1 * 7/2001 Onizuka ..... H01R 9/2458 439/876
6,723,924 B2 * 4/2004 Yuasa ..... H01R 13/17 174/68.2
6,803,523 B2 * 10/2004 Yuasa ..... H01R 13/17 174/88 B
7,004,798 B2 * 2/2006 Yuasa ..... H01R 4/62 439/891
7,040,906 B2 * 5/2006 Yamakawa ..... H01R 4/029 439/276
7,044,807 B2 * 5/2006 Furuno ..... H01R 12/585 439/751
7,118,430 B1 * 10/2006 Henry ..... H01R 4/023 439/884

(Continued)

FOREIGN PATENT DOCUMENTS

JP 2007-95661 A 4/2007

*Primary Examiner* — Peter G Leigh
(74) *Attorney, Agent, or Firm* — Kenealy Vaidya LLP

(57) ABSTRACT

A relay terminal includes: a bus bar having a flat-plate shape or a bent-plate shape; a press fit terminal having a flat-plate shape or a bent-plate shape, and connected to a one end portion of the bus bar in an extending direction of the bus bar, and having a pressing surface to be press-inserted into a through hole; and a second terminal connected to an another end portion of the bus bar in the extending direction of the bus bar, and being configured to be connected to a device terminal. The pressing surface has a plated layer on a first metal base material of the press fit terminal. A second metal base material of the bus bar is exposed on a side surface of the bus bar, the side surface extending along the extending direction of the bus bar.

1 Claim, 5 Drawing Sheets

(56) References Cited

U.S. PATENT DOCUMENTS

| | | | | |
|---|---|---|---|---|
| 7,442,098 | B2 * | 10/2008 | Uchida | H01R 13/055 439/877 |
| 7,837,521 | B2 * | 11/2010 | Kato | H01R 13/113 439/843 |
| 8,771,028 | B2 * | 7/2014 | Tonosaki | H01R 12/585 439/886 |
| 2004/0043645 | A1 * | 3/2004 | Yamakawa | H05K 3/328 439/76.2 |
| 2004/0048524 | A1 * | 3/2004 | Yuasa | H01R 4/62 439/891 |
| 2005/0181651 | A1 * | 8/2005 | Matsumura | H01R 12/585 439/259 |
| 2007/0049132 | A1 * | 3/2007 | Uchida | H01R 13/113 439/891 |
| 2019/0081439 | A1 * | 3/2019 | Schneider | H01R 12/716 |
| 2019/0140376 | A1 * | 5/2019 | Shirai | H01R 12/585 |

* cited by examiner

RELAY TERMINAL, AND METHOD FOR PRODUCING RELAY TERMINAL

CROSS-REFERENCE TO RELATED APPLICATIONS

This application is based on and claims priority under 35 USC 119 from Japanese Patent Application No. 2019-177674 filed on Sep. 27, 2019, the contents of which are incorporated herein by reference.

TECHNICAL FIELD

The present invention relates to a relay terminal, and a method for producing the relay terminal.

BACKGROUND ART

Conventionally, a relay terminal that is used for electrically connecting a through hole disposed in a circuit board, and a device-side terminal disposed on an electric device to each other is known. When a through hole and a device-side terminal are electrically connected to each other by such a relay terminal, it is possible to supply an electric power from a power supply connected to a circuit board to an electric device, and enable a controller disposed on the circuit board to control the electric device.

As for details of the above relay terminal, refer to JP 2007-95661 A.

The relay terminal disclosed in the patent literature is formed in the following manner. Press fit terminals having press-insertion portions that are to be press-inserted into through holes of a circuit board, respectively are formed integrally with one end portion of a bus bar. A second terminal that is to be connected to a device-side terminal of an electric device is joined to the other end portion of the bus bar.

When a terminal component in which a plating process is performed on the surface for the purpose of rust-proofing and the like is to be produced, usually, one of the following processes is executed: a process of performing a plating process on a flat plate made of a metal base material, and then performing a pressing process on the flat plate (hereinafter, the process is referred to as "pre-plating process"); and another process of performing a pressing process on a flat plate made of a metal base material, and then performing a plating process on the flat plate (hereinafter, the process is referred to as "post-plating process"). In the pre-plating process, the shape of the target object on which the plating process is to be performed is a flat plate shape having a simple profile shape (typically, a rectangular shape). Therefore, the plating process can be easily performed as compared with the post-plating process in which the shape of the target object on which the plating process is to be performed is possibly a three-dimensional shape having a complicated profile shape. In the viewpoint of reduction of production cost, consequently, the pre-plating process is preferably employed.

When the pre-plating process is performed on "bus bar with which press fit terminals are integrally formed" in the relay terminal disclosed in the patent literature, the pressing surfaces of the press fit terminals are formed as shear surfaces caused by the pressing process, and hence the surface of the metal base material is exposed from the pressing surfaces. Therefore, the post-plating process must be performed on "bus bar with which press fit terminals are integrally formed."

In a relay terminal that is used in the case where the relative distance between a through hole of a circuit board and a device-side terminal is relatively large, for example, "bus bar with which press fit terminals are integrally formed" connecting the press fit terminal and the second terminal to each other has an elongated shape. Therefore, the size of "bus bar with which press fit terminals are integrally formed" is enlarged, and the post-plating process on "bus bar with which press fit terminals are integrally formed" is executed more hardly.

SUMMARY OF INVENTION

Aspect of non-limiting embodiments of the present disclosure relates to provide a relay terminal in which, even in the case where a bus bar that connects a press fit terminal and a second terminal to each other has an elongated shape, the post-plating process can be easily performed on the press fit terminal, and a method for producing the relay terminal.

Aspects of certain non-limiting embodiments of the present disclosure address the features discussed above and/or other features not described above. However, aspects of the non-limiting embodiments are not required to address the above features, and aspects of the non-limiting embodiments of the present disclosure may not address features described above.

According to an aspect of the present disclosure, there is provided a relay terminal to electrically connect a through hole of a circuit board with a device terminal of an electric device, the relay terminal comprising:

a bus bar having a flat-plate shape or a bent-plate shape;

a press fit terminal having a flat-plate shape or a bent-plate shape, and connected to a one end portion of the bus bar in an extending direction of the bus bar, and having a pressing surface to be press-inserted into the through hole; and a second terminal connected to an another end portion of the bus bar in the extending direction of the bus bar, and being configured to be connected to the device terminal, the pressing surface having a plated layer on a first metal base material of press fit terminal, a second metal base material of the bus bar being exposed on a side surface of the bus bar, the side surface extending along the extending direction of the bus bar.

BRIEF DESCRIPTION OF DRAWINGS

Exemplary embodiment(s) of the present invention will be described in detail based on the following figures, wherein.

DESCRIPTION OF EMBODIMENTS

Hereinafter, a relay terminal 1 of an embodiment of the invention, and a method for producing the relay terminal 1 will be described with reference to the drawings. For example, the relay terminal 1 (see FIG. 1A) is used for electrically connecting through holes (not shown) disposed in a circuit board, and a device-side terminal (not shown) disposed on an electric device (typically, a motor) to each other. When the through holes and the device-side terminal are electrically connected to each other by the relay terminal 1, it is possible to supply an electric power from a power supply connected to the circuit board to the electric device, and enable a controller (ECU) disposed on the circuit board to control the electric device.

Figure 1A:
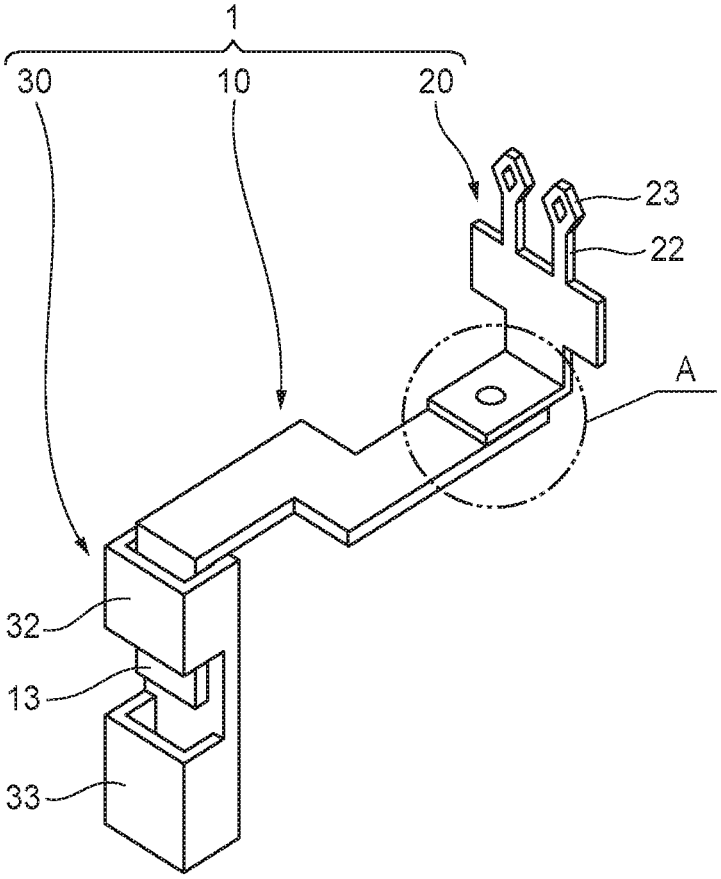
FIG. 1A is a perspective view of a relay terminal according to an exemplary embodiment of the present invention.

As shown in FIG. 1A, the relay terminal 1 is configured by a bus bar 10, a press fit terminal 20 that is joined to one end portion 12 of the bus bar 10, and a second terminal 30 that is joined to another-end portion 13 of the bus bar 10. Hereinafter, the components constituting the relay terminal 1 will be sequentially described.

Figure 2A:
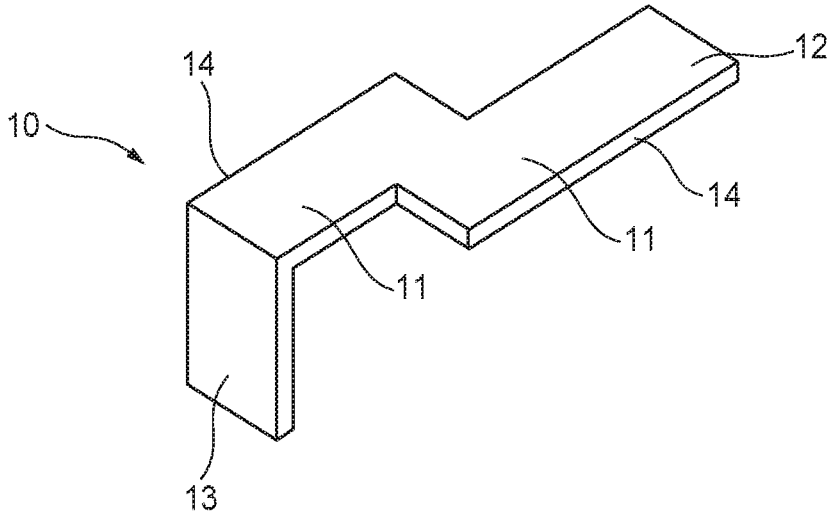
FIG. 2A is a perspective view of a bus bar shown in FIG. 1A.

First the bus bar 10 will be described. In the embodiment, as shown in FIG. 2A, the bus bar 10 has a shape that is obtained by bending an elongated flat plate, and includes a bus bar body portion 11 having an elongated flat plate shape. A part that is bent into a crank-like shape in the plane of the bus bar body portion 11 is formed in the middle portion in the extending direction of the bus bar body portion 11. In the embodiment, the one end portion 12 in the extending direction of the bus bar body portion 11 is a planer portion that extends in the plane of the bus bar body portion 11, and joined to a joining portion 24 (described later) of the press fit terminal 20. In the embodiment, the other-end portion 13 in the extending direction of the bus bar body portion 11 is a planer portion that is bent in the thickness direction of the bus bar body portion 11, and that extends in the thickness direction of the bus bar body portion 11, and to be joined to a joining portion 32 (described later) of the second terminal 30.

In the viewpoint of reduction of production cost, the bus bar 10 is formed by the pre-plating process. Specifically, the plating process is first performed on the whole surface of a flat plate that is made of a metal base material constituting the bus bar 10, and that has a simple profile shape (typically, a rectangular shape). Next, a pressing process and a bending process are performed on the flat plate on which the plating process has been performed, to form the whole shape (three-dimensional shape) of the bus bar 10, whereby the bus bar 10 shown in FIG. 2A is completed. The bending process is performed only in order to form the other-end portion 13 that is bent in the thickness direction of the bus bar body portion 11. As a result of the pressing process, a pair of side end surfaces 14 that extend along the extending direction of the bus bar 10 are formed as shear surfaces caused by the pressing process. That is, the surface of the metal base material constituting the bus bar 10 is exposed from the pair of side end surfaces 14 of the completed bus bar 10.

Figure 2B:
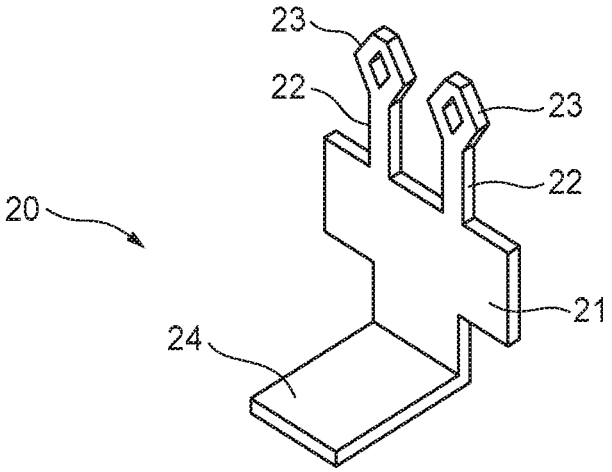
FIG. 2B is a perspective view of a press fit terminal shown in FIG. 1A.

Next, the press fit terminal 20 will be described. In the embodiment, as shown in FIG. 2B, the press fit terminal 20 has a shape that is obtained by bending a flat plate, and includes a planar body portion 21. A pair of press-insertion portions 22 that have a slender flat plate shape, and that elongate in one side in the plane of the body portion 21 are integrally formed on one side of the planar body portion 21. In each of the press-insertion portions 22, the pair of side end surfaces of the tip end part expand in the width direction as compared with a pair of side end surfaces of the other part of the press-insertion portions 22, and function as pressing surfaces 23 that are to be inserted into the through holes of the circuit board. The planar joining portion 24 that is bent in the thickness direction of the body portion 21, and that extends in the thickness direction of the body portion 21 is formed integrally on the other side of the body portion 21.

Figure 3:
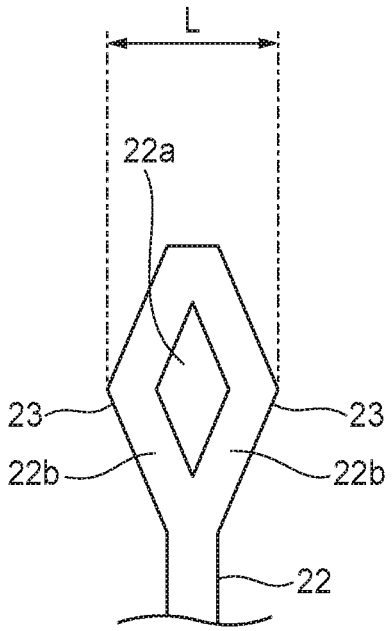
FIG. 3 is a plan view enlargedly showing a press-insertion portion of the press fit terminal.

Here, one of the press-insertion portions 22 will be additionally described. The following description is applicable also to the other press-insertion portion 22. In the press-insertion portion 22, as shown in FIG. 3, a passing through hole 22*a* that passes through the body portion 21 in the thickness direction is disposed in the tip end part (the part where the pair of side end surfaces expand in the width direction as compared with the other part of the press-insertion portion 22, or the part interposed between the pair of pressing surfaces 23). As a result, a pair of elastic pieces 22*b* that define the passing through hole 22*a* are formed. The side end surfaces in the outer sides in the width direction of the pair of elastic pieces 22*b* function as the pair of pressing surfaces 23. The maximum width L (see FIG. 3) of the tip end part of the press-insertion portion 22 is larger than the inner diameter of the through hole of the circuit board, by a value corresponding to the press-insertion distance. When the press-insertion portion 22 is to be inserted (press-inserted) into the through hole, therefore, parts of the pressing surfaces 23 butt against an edge portion of the through hole, and then the pair of elastic pieces 22*b* are caused to advance to a press-insertion completion position in the through hole by the pressure of the inner wall of the through hole while maintaining a state where the elastic pieces are elastically deformed toward the inner side in the width direction.

As a result, in the state where the press insertion of the press-insertion portion 22 into the through hole is completed (the state where the pair of elastic pieces 22*b* are at the press-insertion completion position in the through hole), a state where pressing forces due to the elastic resilient forces of the pair of elastic pieces 22*b* act between the pressing surfaces 23 and the inner wall of the through hole is maintained. Therefore, the press-insertion portion 22 is surely held by the through hole, and the reliability of the electrical contact between the press-insertion portion 22 (i.e., the press fit terminal 20) and the circuit board is improved.

The press fit terminal 20 is formed by the post-plating process. Specifically, first, a pressing process and a bending process are performed on a flat plate that is made of a metal base material constituting the press fit terminal 20, and that has a simple profile shape (typically, a rectangular shape), and the whole shape (three-dimensional shape) of the press fit terminal 20 is formed. The bending process is performed only in order to form the joining portion 24 that is bent in the thickness direction of the body portion 21. As a result of the pressing process, a pair of side end surfaces that extend along the extending direction of the press fit terminal 20 (more specifically, the pair of side end surfaces of each of the body portion 21, the press-insertion portions 22, and the joining portion 24) are formed as shear surfaces caused by the pressing process, and the surface of the metal base material constituting the press fit terminal 20 is exposed therefrom.

Then, the plating process is performed on the whole surface of the press fit terminal 20 on which the pressing process and the bending process have been performed, whereby the press fit terminal 20 shown in FIG. 2B is completed. Namely, the plating process is performed also on the pressing surfaces 23 of the completed press fit terminal 20.

Figure 4:
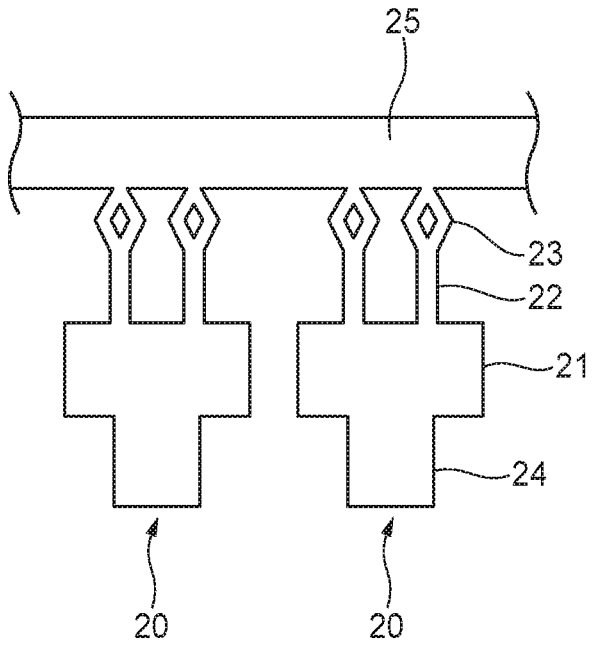
FIG. 4 is a plan view showing a plurality of press fit terminals that are coupled together so as to be arranged in a row, by a strip-shaped carrier.

In the above-described embodiment, after a pressing process and a bending process are performed on a flat plate, a plating process is performed. Alternatively, the press fit terminal 20 may be completed in the following manner. First, only a pressing process is performed on a flat plate, and a plurality of planer press fit terminals 20 that are coupled together by a strip-shaped carrier 25 so as to be arranged in a row as shown in FIG. 4 are formed. Next, a plating process is performed collectively on the whole surfaces of the plurality of planer press fit terminals 20 while maintaining the state where the plurality of planer press fit terminals 20 are coupled together by the carrier 25. Then, a bending process is performed on each of the planer press fit terminals 20 that are separated from the carrier 25, to form the joining portion 24 that is bent in the thickness direction of the body portion 21, thereby completing the press fit terminal 20.

The plating process is performed collectively on the plurality of planer press fit terminals 20 that are in the stage where the bending process is not yet performed, and that are coupled together by the carrier 25 as shown in FIG. 4, and therefore the plating process on the plurality of planer press fit terminals 20 is very easily executed.

Figure 2C:
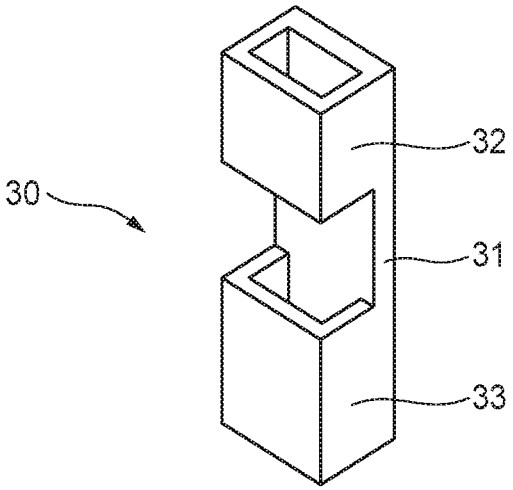
FIG. 2C is a perspective view of a second terminal shown in FIG. 1A.

Next, the second terminal 30 will be described. In the embodiment, as shown in FIG. 2C, the second terminal 30 has a shape that is obtained by bending a flat plate, and includes a planar body portion 31. A rectangular tubular-shaped joining portion 32 is formed in one side of the body portion 31, and a rectangular tubular-shaped connecting portion 33 that is positioned coaxially with the joining portion 32 is formed in the opposite side of the body portion 31. A device-side terminal (male terminal) disposed on the electric device is to be inserted into the connecting portion 33.

In the viewpoint of reduction of production cost, the second terminal 30 is formed by the pre-plating process similarly with the bus bar 10. Specifically, a plating process is performed on the whole surface of a flat plate that is made of a metal base material constituting the second terminal 30, and that has a simple profile shape (typically, a rectangular shape). Next, a pressing process and a bending process are performed on the flat plate on which the plating process has been performed, to form the whole shape (three-dimensional shape) of the second terminal 30, whereby the second terminal 30 shown in FIG. 2C is completed. The bending process is performed in order to form the joining portion 32 and connecting portion 33 that have a rectangular tubular shape. In the above, the components constituting the relay terminal 1 have been described.

Figure 1B:
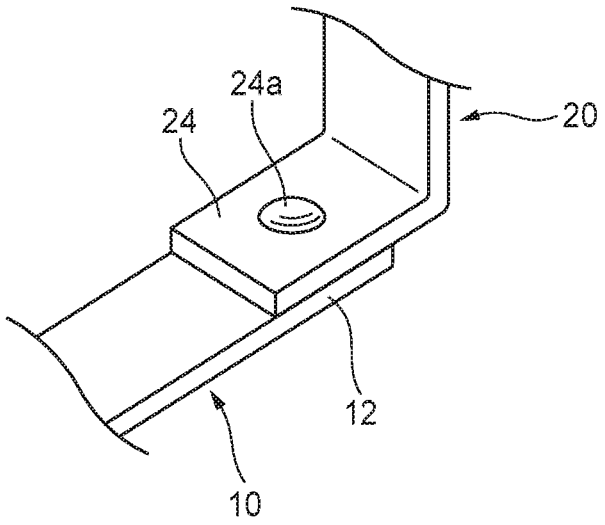
FIG. 1B is an enlarged view of portion A of FIG. 1A.

The relay terminal 1 shown in FIG. 1A is completed by joining the joining portion 24 of the press fit terminal 20 to the one end portion 12 of the bus bar 10, and further joining the joining portion 32 of the second terminal 30 to the other-end portion 13 of the bus bar 10. In the embodiment, the joining between the one end portion 12 of the bus bar 10 and the joining portion 24 of the press fit terminal 20 is realized by welding a place where the one end portion 12 of the bus bar 10 and the joining portion 24 of the press fit terminal 20 are stacked with each other in the thickness direction as shown in FIG. 1B. In the example shown in in FIG. 1B, a spot weld mark 24*a* is indicated. The joining between the other-end portion 13 of the bus bar 10 and the joining portion 32 of the second terminal 30 is realized by inserting the planar other-end portion 13 of the bus bar 10 into the hollow space of the rectangular tubular-shaped joining portion 32 of the second terminal 30.

According to the relay terminal 1 of the embodiment, as described above, the relay terminal 1 is formed by joining together the press fit terminal 20 and bus bar 10 that are independent from each other. When the press fit terminal 20 is formed by the post-plating process, and the bus bar 10 is formed by the pre-plating process, therefore, it is possible to obtain the relay terminal 1 in which the plating process is performed on the pressing surfaces 23 of the press fit terminal 20 that are formed as shear surfaces caused by the pressing process, and the surface of the metal base material is exposed from the side end surfaces 14 that are formed as shear surfaces caused by the pressing process, and that extend in the extending direction of the bus bar 10. Here, the press fit terminal 20 and the bus bar 10 are independent from each other. Even when the bus bar 10 has an elongated shape, therefore, the size of the press fit terminal 20 itself is not enlarged, and hence the post-plating process can be easily performed on the press fit terminal 20.

Moreover, the configuration where the press fit terminal 20 and the bus bar 10 are independent from each other can attain the following effect. Even in the case where there are a plurality of relative positional relationships between a through hole of a circuit board and a device-side terminal, when a plurality of kinds are prepared with respect to only the bus bar 10, the press fit terminal 20 can be commonalized.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

Figure 5:
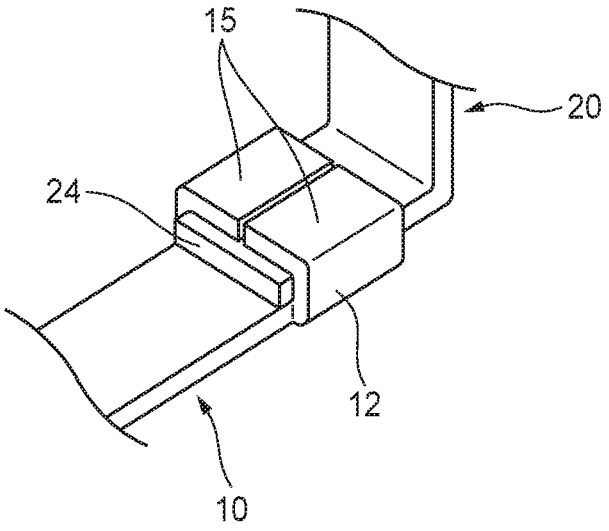
FIG. 5 is a view showing a modification of a joining portion between the bus bar and the press fit terminal, and corresponding to FIG. 1B.

In the embodiment, for example, the joining between the one end portion 12 of the bus bar 10 and the joining portion 24 of the press fit terminal 20 is realized by welding a place where the one end portion 12 of the bus bar 10 and the joining portion 24 of the press fit terminal 20 are stacked with each other in the thickness direction (see FIG. 1B). Alternatively, as shown in FIG. 5, the joining between the one end portion 12 of the bus bar 10 and the joining portion 24 of the press fit terminal 20 may be realized by crimping a pair of crimping pieces 15 that extend respectively from a pair of side end parts of the one end portion 12 of the bus bar 10, to the joining portion 24 of the press fit terminal 20.

Although, in the embodiment, the bus bar 10 has a shape that is obtained by bending an elongated flat plate, the whole bus bar 10 may have an elongated flat plate shape (that has not been subjected to a bending process). Similarly, although the press fit terminal 20 has a shape that is obtained by bending a flat plate, the whole press tit terminal 20 may have a flat plate shape (that has not been subjected to a bending process).

In the embodiment, the press fit terminal 20 is formed by the post-plating process, and the bus bar 10 and the second terminal 30 are formed by the pre-plating process. Alternatively, the press fit terminal 20 and the second terminal 30 may be formed by the post-plating process, and the bus bar 10 may be formed by the pre-plating process.

According to the above exemplary embodiments, the relay terminal (1) is used to electrically connect a through hole of a circuit board with a device terminal of an electric device. The relay terminal (1) comprises:

a bus bar (10) having a flat-plate shape or a bent-plate shape;

a press fit terminal (20) having a flat-plate shape or a bent-plate shape, and connected to a one end portion (12) of the bus bar (10) in an extending direction of the bus bar (10), and having a pressing surface (23) to be press-inserted into the through hole; and a second terminal (30) connected to an another end portion (13) of the bus bar (10) in the extending direction of the bus bar (10), and being configured to be connected to the device terminal, the pressing surface (23) having a plated layer on a first metal base material of the press fit terminal (20), a second metal base material of the bus bar (10) being exposed on a side surface (14) of the bus bar (10), the side surface (14) extending along the extending direction of the bus bar (10).

According to the relay terminal having the above-described configuration, the relay terminal is formed by joining together the press fit terminal and bus bar that are independent from each other. When the press fit terminal is formed by the post-plating process, and the bus bar is formed by the pre-plating process, therefore, it is possible to obtain a relay terminal which has the above-described configuration, and in which the plating process is performed on the pressing surfaces of the press fit terminal that are formed as shear surfaces caused by the pressing process, and the surface of the metal base material is exposed from the side end surfaces that are formed as shear surfaces caused by the pressing process, and that extend in the extending direction of the bus bar. Here, the press fit terminal and the bus bar are independent from each other. Even when the bus bar has an elongated shape, therefore, the size of the press fit terminal itself is not enlarged, and hence the post-plating process can be easily performed on the press fit terminal.

Moreover, the configuration where the press fit terminal and the bus bar are independent from each other can attain the following effect. Even in the case where there are a plurality of relative positional relationships between a through hole of a circuit board and a device-side terminal, when a plurality of kinds are prepared with respect to only the bus bar, the press fit terminal can be commonalized.

According to the above exemplary embodiments, the method for producing the relay terminal (1) comprises:

forming the press fit terminal (20) with the plated layer on the pressing surface (23) by performing a pressing process on a first flat plate comprising the first metal base material, and then performing a plating process at least on a shear surface corresponding to the pressing surface (23), the shear surface being formed through the pressing process on the first metal base material;

forming the bus bar (10) having a shear surface of the second metal base material on the side surface (14) of the bus bar (10) by performing a plating process on a surface of a second flat plate comprising the second metal base material, and then performing a pressing process on the second flat plate;

forming the second terminal (30); and connecting the press tit terminal (20) to the one end portion (12) of the bus bar (10), and connecting the second terminal (30) to the another end portion (13) of the bus bar (10).

A relay terminal having the above-described configuration can be produced by employing the above-described method for producing a relay terminal. In the case where the manufacturing method is employed, when the press fit terminal is formed by the post-plating process, and the bus bar is formed by the pre-plating process, it is possible to obtain a relay terminal which has the above-described configuration, and in which the plating process is performed on the pressing surfaces of the press fit terminal that are formed as shear surfaces caused by the pressing process, and the surface of the metal base material is exposed from the side end surfaces that are formed as shear surfaces caused by the pressing process, and that extend in the extending direction of the bus bar. Here, the press fit terminal and the bus bar are independent from each other. Even when the bus bar has an elongated shape, therefore, the size of the press fit terminal itself is not enlarged, and hence the post-plating process can be easily performed on the press fit terminal.

According to the invention, it is possible to provide a relay terminal in which, even in the case where a bus bar that connects a press fit terminal and a second terminal to each other has an elongated shape, the post-plating process can be easily performed on the press fit terminal, and a method for producing the relay terminal.

What is claimed is:

1. A method for producing the relay terminal to electrically connect a through hole of a circuit board with a device terminal of an electric device, the relay terminal including: a bus bar having a flat-plate shape or a bent-plate shape; a press fit terminal having a flat-plate shape or a bent-plate shape, and connected to and stacked onto a one end portion of the bus bar in an extending direction of the bus bar, and having a pressing surface to be press-inserted into the through hole; and a second terminal connected to an another end portion of the bus bar in the extending direction of the bus bar, and being configured to be connected to the device terminal, the pressing surface having a plated layer on a first metal base material of the press fit terminal, a second metal base material of the bus bar being exposed on a side surface of the bus bar, the side surface extending along the extending direction of the bus bar, the method comprising:

forming the press fit terminal with the plated layer on the pressing surface by performing a pressing process on a first flat plate comprising the first metal base material, and then performing a plating process at least on a shear surface corresponding to the pressing surface, the shear surface being formed through the pressing process on the first metal base material;

forming the bus bar having a shear surface of the second metal base material on the side surface of the bus bar by performing a plating process on a surface of a second flat plate comprising the second metal base material, and then performing a pressing process on the second flat plate;

forming the second terminal; and connecting the press fit terminal to the one end portion of the bus bar, and connecting the second terminal to the another end portion of the bus bar.

* * * * *